US010422177B2

(12) United States Patent
Suzuki et al.

(10) Patent No.: US 10,422,177 B2
(45) Date of Patent: Sep. 24, 2019

(54) VEHICULAR WINDOW REGULATOR AND INCLINATION RESTRAINING MECHANISM

(71) Applicant: SHIROKI CORPORATION, Fujisawa-shi, Kanagawa (JP)

(72) Inventors: Kenichi Suzuki, Fujisawa (JP); Kenji Yamamoto, Fujisawa (JP); Masato Sakamoto, Fujisawa (JP)

(73) Assignee: SHIROKI CORPORATION, Fujisawa-Shi, Kanagawa (JP)

( * ) Notice: Subject to any disclaimer, the term of this patent is extended or adjusted under 35 U.S.C. 154(b) by 267 days.

(21) Appl. No.: 15/513,772

(22) PCT Filed: Sep. 25, 2015

(86) PCT No.: PCT/JP2015/077054
§ 371 (c)(1),
(2) Date: Mar. 23, 2017

(87) PCT Pub. No.: WO2016/047735
PCT Pub. Date: Mar. 31, 2016

(65) Prior Publication Data

US 2017/0284145 A1 Oct. 5, 2017

(30) Foreign Application Priority Data

Sep. 26, 2014 (JP) ..... 2014-196853

(51) Int. Cl.
*E05F 11/48* (2006.01)
*E05F 15/689* (2015.01)
*E05D 15/16* (2006.01)

(52) U.S. Cl.
CPC ..... *E05F 15/689* (2015.01); *E05D 15/165* (2013.01); *E05F 11/48* (2013.01); *E05Y 2900/55* (2013.01)

(58) Field of Classification Search
CPC ..... E05F 11/48
(Continued)

(56) References Cited

U.S. PATENT DOCUMENTS 4,468,887 A * 9/1984 Koch ..... E05F 11/382 49/352
5,528,861 A * 6/1996 Beyerlein ..... E05F 11/485 49/349

(Continued)

FOREIGN PATENT DOCUMENTS

JP 60-110572 U 7/1985
JP 03087488 A * 4/1991

(Continued)

OTHER PUBLICATIONS

International Search Report (PCT/ISA/210) dated Nov. 10, 2015, by the Japanese Patent Office as the International Searching Authority for International Application No. PCT/JP2015/077054.

(Continued)

*Primary Examiner* — Jerry E Redman
(74) *Attorney, Agent, or Firm* — Buchanan Ingersoll & Rooney PC

(57) ABSTRACT

A vehicular window regulator that decreases an inclination of a glass centering on a thickness direction of the glass and an inclination restraining mechanism are provided. The window regulator includes a member secured to a glass, traction member guides. At least one of the traction member guides are each disposed above and below the member, across the member. The inclination restraining mechanism is wound across the respective traction member guides, and includes a traction member having one end portion installed at the member from above, and further having another end portion installed at the member from below. An installation position to the member, of the one end portion of the traction member and an installation position to the member, of the (Continued)

other end portion of the traction member are offset in a horizontal direction, viewing from a thickness direction of the glass.

5 Claims, 12 Drawing Sheets

(58) Field of Classification Search
USPC ..... 49/352
See application file for complete search history.

(56) References Cited

U.S. PATENT DOCUMENTS

| | | | | |
|---|---|---|---|---|
| 2003/0233791 | A1* | 12/2003 | Benoit | E05F 11/488 49/352 |
| 2006/0185248 | A1* | 8/2006 | Kollner | E05F 11/488 49/352 |
| 2008/0202031 | A1* | 8/2008 | Huge | E05F 11/486 49/352 |
| 2009/0000202 | A1* | 1/2009 | Eckhardt | E05F 11/382 49/352 |
| 2013/0227889 | A1* | 9/2013 | Matsushita | E05F 11/483 49/352 |

FOREIGN PATENT DOCUMENTS

| | | | |
|---|---|---|---|
| JP | 03279574 | A | * 12/1991 |
| JP | 05287953 | A | * 11/1993 |
| JP | 11-270223 | A | 10/1999 |
| JP | 2009-185475 | A | 8/2009 |

OTHER PUBLICATIONS

Written Opinion (PCT/ISA/237) dated Nov. 10, 2015, by the Japanese Patent Office as the International Searching Authority for International Application No. PCT/JP2015/077054.

* cited by examiner

VEHICULAR WINDOW REGULATOR AND INCLINATION RESTRAINING MECHANISM

TECHNICAL FIELD

The present invention relates to a vehicular window regulator that lowers and raises a glass in a vertical direction and an inclination restraining mechanism. For more detail, the present invention relates to a vehicular window regulator that decreases an inclination of a glass centering on a thickness direction of the glass and a mechanism that restrains the inclination of the glass.

BACKGROUND ART

A vehicular window regulator includes what is called a single-guide-type vehicular window regulator 1 illustrated in FIG. 14.

In the drawing, a slider 7 to which a glass 5 is secured is movably engaged with one guide rail 3 positioned in a space between an inner panel and an outer panel of a door and disposed along a vertical direction of the inner panel.

An upper wire guide 9 is disposed at an upper portion of the guide rail 3. A lower wire guide 11 is disposed at a lower portion of the guide rail 3.

A driving portion 19 including a drum 15 around which a wire 13 and a wire 14 are wound and a motor 17 that drives the drum 15 is disposed at a door panel.

The wire 13 wound around the drum 15 is installed at the slider 7 from above, via the upper wire guide 9. The wire 14 wound around the drum 15 is installed at the slider 7 from below, via the lower wire guide 11.

The upper wire guide 9, the lower wire guide 11, and installation positions to the slider 7 of the wire 13 and the wire 14 are configured such that the wire 13 from the upper wire guide 9 to the slider 7 and the wire 14 from the lower wire guide 11 to the slider 7 are on approximately an identical straight line.

Accordingly, when the motor 7 of the driving portion 19 normally rotates, the wire 13 is drawn (paid out) from the drum 15, and then, the wire 14 is pulled (rolled up). The glass 5 secured to the slider 7 is pulled by the wire 14 to lower along the guide 3.

Conversely, when the motor 17 of the driving portion 19 reversely rotates, the wire 13 is pulled (rolled up) from the drum 15, and then, the wire 14 is drawn (paid out). The glass 5 secured to the slider 7 is pulled by the wire 13 to rise along the guide 3 (for example, see PATENT LITERATURE 1).

CITATION LIST

Patent Literature

PATENT LITERATURE 1 JP-A-2009-185475

SUMMARY OF THE INVENTION

Problems to be Solved by the Invention

At a vehicular window regulator having a structure as illustrated in FIG. 14, one slider 7 supports the glass 5. Then, this slider 7 is pulled by the wire 13 and the wire 14 that are on the identical straight line to be considered as one wire.

Accordingly, the glass 5 secured to the slider 7 is supported at a single point. Therefore, depending on a position of a center of gravity of the glass 5, the glass 5 may attempt to incline toward a forward direction or a rear direction of a vehicle. That is, a problem that the glass 5 inclines toward a normal rotation direction or a reverse rotation direction centering on a thickness direction (a direction perpendicular to a paper surface in FIG. 14) of the glass 5 is generated.

When the glass 5 inclines, the glass 5 lowers and rises while scratching a door sash. Therefore, abnormal noise is generated in lowering and rising. Furthermore, driving force required for lowering and rising increases.

The present invention has been made in view of the above-described problems. It is an object of the present invention to provide a vehicular window regulator that decreases an inclination of a glass centering on a thickness direction of the glass and an inclination restraining mechanism.

Solution to the Problems

In order to solve at least one of the above objects, a vehicular window regulator reflecting an aspect of the present invention includes: a raising/lowering mechanism that includes a driving portion that generates driving force that lowers and raises a glass, and lowers and raises the glass in a vertical direction; and an inclination restraining mechanism that is driven by raising/lowering operation of the raising/lowering mechanism, and restrains rotation of the glass centering on a thickness direction of the glass. The raising/lowering mechanism includes: one guide rail disposed along the vertical direction; a slider movably engaged with the guide rail, and to which the glass is secured; a wire guide disposed at at least one of an upper portion of the guide rail and a lower portion of the guide rail; a wire that includes a part wound on the wire guide to be installed at the slider, and further pulls the slider along the guide rail; and the driving portion that includes a drum on which the wire is wound to rotate the drum to pull out and draw in the wire. The inclination restraining mechanism includes: a member secured to the glass; traction member guides disposed at a door panel or a member disposed at the door panel, and at least one of the traction member guides each being disposed above and below the member secured to the glass, across the member secured to the glass; and a traction member that is wound across the respective traction member guides, has one end portion installed from above at the member secured to the glass, and further has another end portion installed from below at the member secured to the glass. An installation position to the member secured to the glass at the one end portion of the traction member and an installation position to the member secured to the glass at the other end portion of the traction member are offset in a horizontal direction, viewing from the thickness direction of the glass.

In order to solve at least one of the above objects, an inclination restraining mechanism reflecting an aspect of the present invention that is driven by raising/lowering operation of a raising/lowering mechanism that includes a driving portion that generates driving force that lowers and raises a glass, the raising/lowering mechanism lowering and raising the glass in a vertical direction, the inclination restraining mechanism restraining rotation of the glass centering on a thickness direction of the glass, includes: a member secured to the glass; traction member guides disposed at a door panel or a member disposed at the door panel, and at least one of the traction member guides each being disposed above and below the member secured to the glass, across the member secured to the glass; and a traction member that is wound across the respective traction member guides, has one end portion installed from above at the member secured to the glass, and further has another end portion installed from below at the member secured to the glass. An installation position to the member secured to the glass at the one end portion of the traction member and an installation position to the member secured to the glass at the other end portion of the traction member are offset in a horizontal direction, viewing from the thickness direction of the glass.

Other features of the present invention will be further apparent from the following description of the embodiment and the accompanying drawings.

Effects of the Invention

The vehicular window regulator of the present invention includes the member secured to the glass, the traction member guides disposed at the door panel or the member disposed at the door panel, and the traction member wound across the respective traction member guides. Then, across the member secured to the glass, at least the one traction member guide is each disposed above and below the member secured to the glass. The one end portion of the traction member is installed from above at the member secured to the glass. The other end portion of the traction member is installed from below at the member secured to the glass. The vehicular window regulator of the present invention includes the inclination restraining mechanism. At this inclination restraining mechanism, the installation position to the member secured to the glass, of the one end portion of the traction member and the installation position to the member secured to the glass, of the other end portion of the traction member are offset in the horizontal direction, viewing from the thickness direction of the glass. This poses tension to the traction member when the glass attempts to incline centering on the thickness direction of the glass. Therefore, the inclination of the glass is restrained.

The inclination restraining mechanism of the present invention includes the member secured to the glass, the traction member guides disposed at the door panel or the member disposed at the door panel, and the traction member wound across the respective traction member guides. Then, across the member secured to the glass, at least the one traction member guide is each disposed above and below the member secured to the glass. The one end portion of the traction member is installed from above at the member secured to the glass. The other end portion of the traction member is installed from below at the member secured to the glass. The vehicular window regulator of the present invention includes the inclination retraining mechanism. At this inclination restraining mechanism, the installation position to the member secured to the glass, of the one end portion of the traction member and the installation position to the member secured to the glass, of the other end portion of the traction member are offset in the horizontal direction, viewing from the thickness direction of the glass. This poses tension to the traction member when the glass attempts to incline centering on the thickness direction of the glass. Therefore, the inclination of the glass is restrained.

Other advantageous effects of the embodiment will be further apparent from the following description of the embodiment and the accompanying drawings.

DESCRIPTION OF THE EMBODIMENTS

First Embodiment

Figure 1:
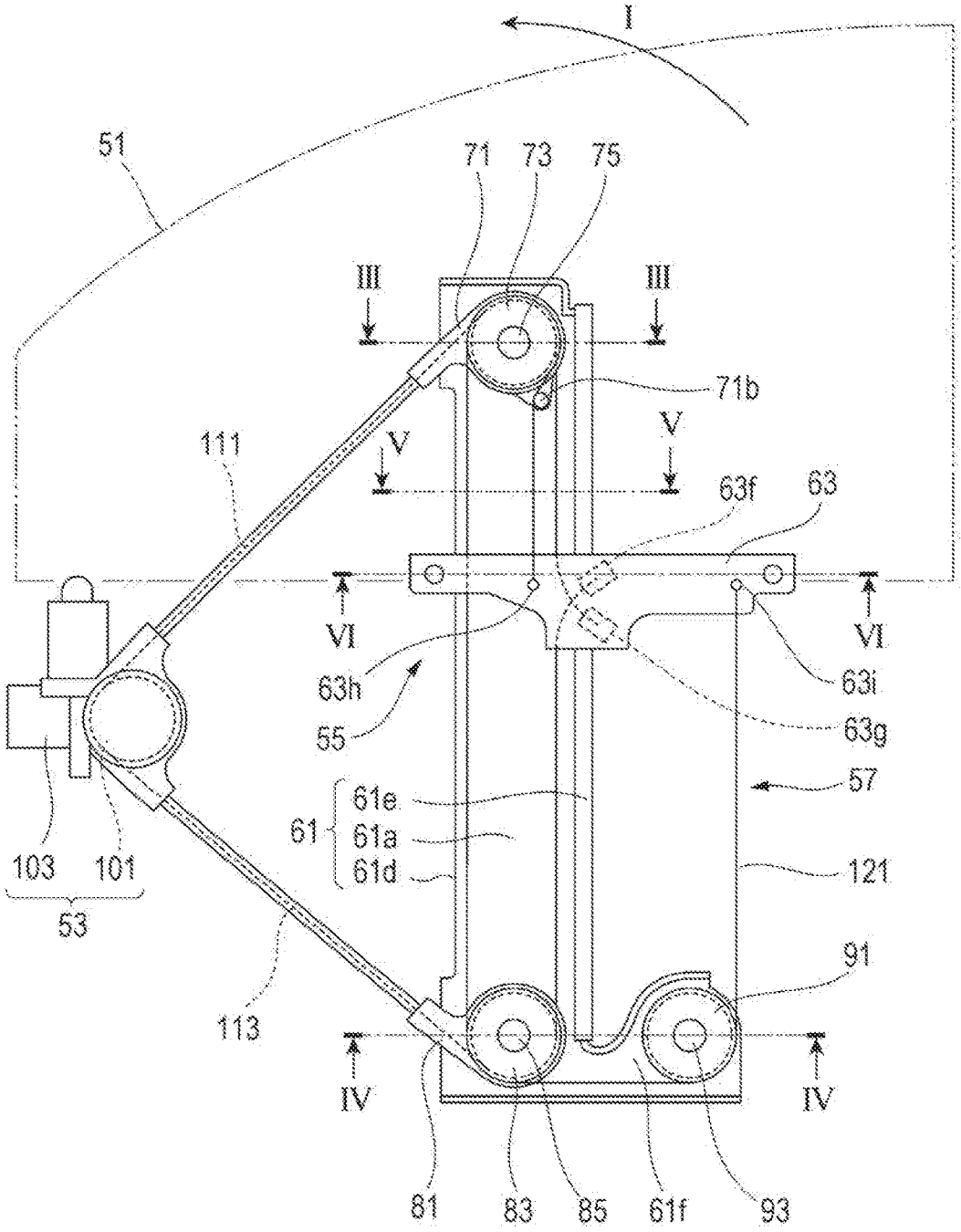
FIG. 1 is a front view of a vehicular window regulator of a first embodiment.
Figure 2:
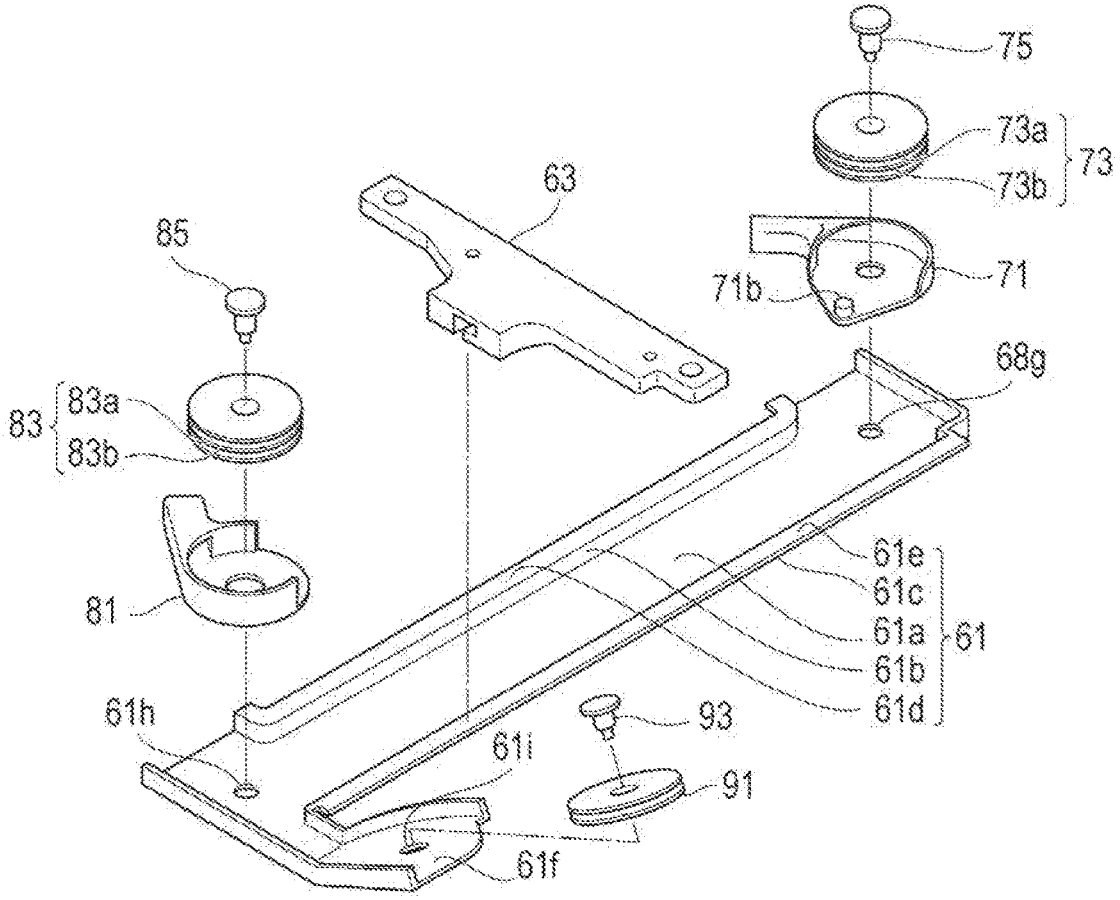
FIG. 2 is an exploded perspective view of a guide rail part in FIG. 1.
Figure 3:
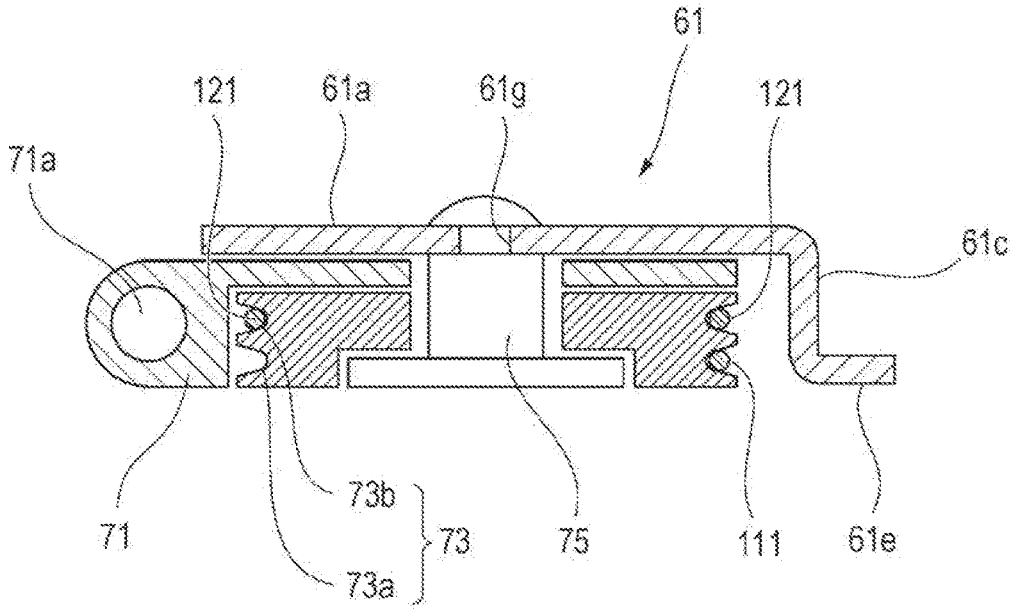
FIG. 3 is a cross-sectional view at section line III-III in FIG. 1.
Figure 4:
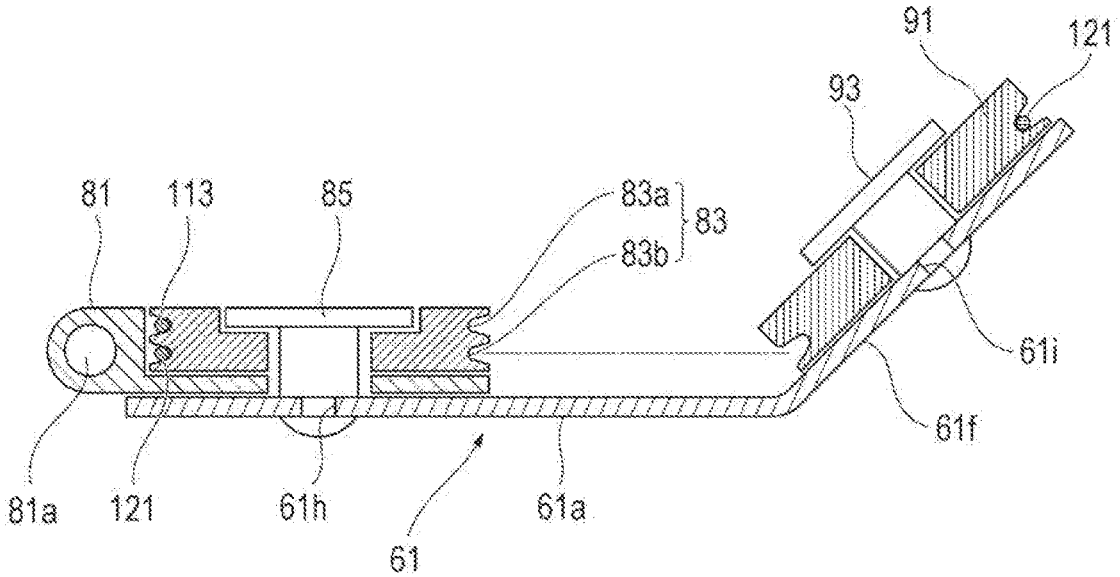
FIG. 4 is a cross-sectional view at section line IV-IV in FIG. 1.
Figure 5:
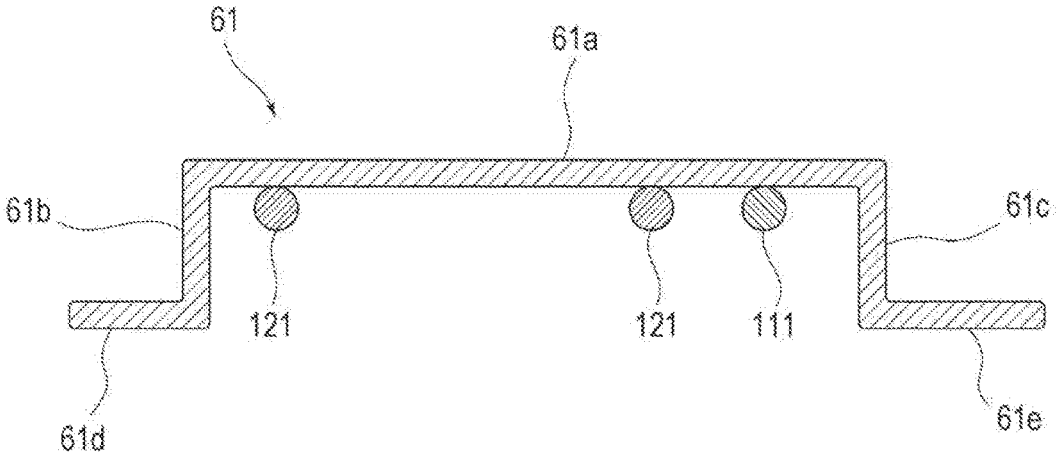
FIG. 5 is a cross-sectional view at section line V-V in FIG. 1.
Figure 6:
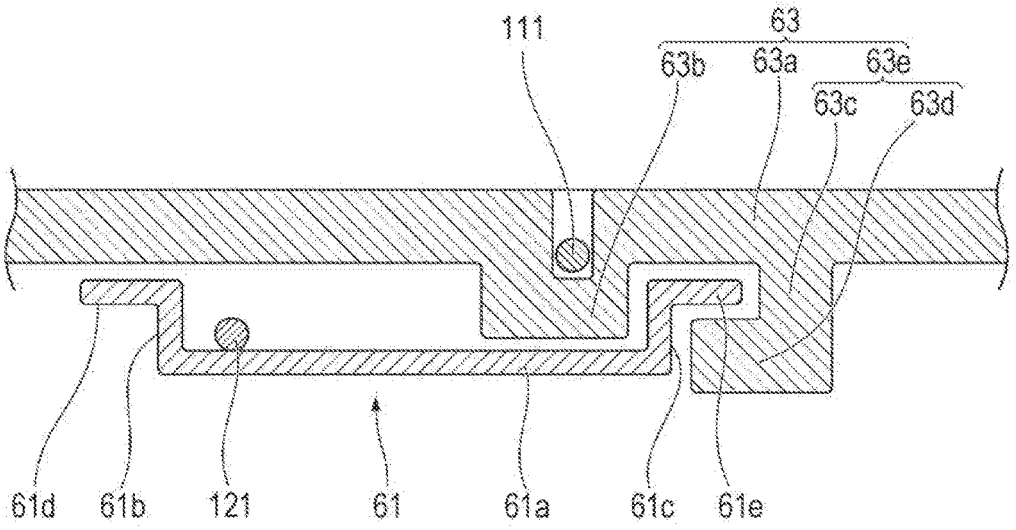
FIG. 6 is a cross-sectional view at section line VI-VI in FIG. 1.

A description will be given using FIGS. 1 to 6. FIG. 1 is a front view of a vehicular window regulator of a first embodiment. FIG. 2 is an exploded perspective view of a guide rail part in FIG. 1, FIG. 3 is a cross-sectional view at section line in FIG. 1. FIG. 4 is a cross-sectional view at section line in FIG. 1. FIG. 5 is a cross-sectional view at section line V-V in FIG. 1. FIG. 6 is a cross-sectional view at section line VI-VI in FIG. 1.

As illustrated in FIG. 1, the vehicular window regulator of this embodiment includes a driving portion 53 that generates driving force that lowers and raises a glass 51. This window regulator includes a raising/lowering mechanism 55 that lowers and raises the glass 51 in a vertical direction. Furthermore, this window regulator includes an inclination restraining mechanism 57 driven by raising/lowering operation of the raising/lowering mechanism 55. Then, this inclination restraining mechanism 57 restrains rotation of the glass 51 centering on a thickness direction (a direction perpendicular to a paper surface in FIG. 1) of the glass 51.

(Raising/Lowering Mechanism 55)

The raising/lowering mechanism 55 will be described using FIGS. 1 to 6.

In FIG. 1, a direction approaching the paper surface in a direction perpendicular to the paper surface is a vehicle inward direction (an inner panel direction of a door). Then, a direction separating from the paper surface is a vehicle outward direction (an outer panel direction of the door).

One guide rail 61 is disposed along the vertical direction at the inner panel (a door panel) of the door. This guide rail 61 is positioned in a space between the inner panel and the outer panel.

The guide rail 61, except for its upper portion and lower portion, as illustrated in FIG. 5, includes a base 61*a*, a first wall 61*b* and a second wall 61*c* folded from both sides of the base 61*a* to extend in the vehicle outward direction, and a first flange 61*d* and a second flange 61*e* folded from distal ends of the first wall 61*b* and the second wall 61*c* to extend in a direction parallel to the base 61*a* and separating one another.

The guide rail 61 arches at a vehicle outward side.

A slider 63 to which the glass 51 is secured is movably engaged with the guide rail 61. As illustrated in FIG. 6, the slider 63 includes a main body portion 63*a*. The main body portion 63*a* is disposed above the first flange old and the second flange 61*e* of the guide rail 61, and extends in a direction intersecting with a longitudinal direction of the guide rail 61. A main body portion 61*a* includes a first protrusion 63*b*. The first protrusion 63*b* projects within a space surrounded by the base 61*a*, the first wall 61*b*, and the second wall 61*c* of the guide rail 61. Furthermore, the first protrusion 63*b* is opposed to a surface opposed to the first wall 61*b*, of the second wall 61*c*, via a slight clearance. The main body portion 61*a* includes a second protrusion 63*e*. The second protrusion 63*e* includes a base 63*c* and a distal end portion 63*d*. The base 63*c* is opposed to a side end surface of the second flange 61*e* of the guide rail 61, via a slight clearance. The distal end portion 63*d* is folded from a distal end of the base 63*c*, and opposed to a surface at a vehicle inward side of the second flange 61*e*, via a slight clearance. The distal end portion 63*d* is further opposed to an opposite surface of the surface, which is opposed to the first wall 61*b*, of the second wall 61*c* via a slight clearance.

Then, the first protrusion 63*b* and the second protrusion 63*e* of the slider 63 perform positioning in a width direction of the guide rail 61, of the slider 63 and positioning in a peeling direction from the guide rail 61, of the slider 63. The slider 63 is movable only in the longitudinal direction of the guide rail 61.

As illustrated in FIGS. 1, 2, and 3, an upper guide bracket 71 is installed at an upper portion of the guide rail 61 using a pin 75 disposed at a hole 61*g* formed at the upper portion of the guide rail 61.

Further, an upper pulley (a wire guide) 73 is rotatably installed at the pin 75. Grooves are formed at the upper pulley (the wire guide) 73 in its circumferential direction. Two grooves in the circumferential direction: an upper groove 73*a* and a lower groove 73*b* are formed at the upper pulley 73 of this embodiment.

A guide bore 71*a* is formed at the upper guide bracket 71. The guide bore 71*a* guides a wire taken into and out from a drum of the driving portion 53, which is described later, to the upper groove 73*a* of the upper pulley 73. Further, the guide protrusion 73*b* that guides the wire wound on the upper pulley 73 is formed.

As illustrated in FIGS. 1, 2, and 4, a lower guide bracket 81 is installed at a lower portion of the guide rail 61 using a pin 85 disposed at a hole 61*h* formed at the lower portion of the guide rail 61.

Further, a lower pulley (a wire guide) 83 is rotatably installed at the pin 85. Grooves are formed at the lower pulley (the wire guide) 83 in its circumferential direction. Two grooves in the circumferential direction: an upper groove 83*a* and a lower groove 83*b* are formed at the lower pulley 83 of this embodiment.

A guide bore 81*a* is formed at the lower guide bracket 81. The guide bore 81*a* guides a wire taken into and out from a drum of the driving portion 53, which is described later, to the upper groove 83*a* of the lower pulley 83.

A pulley installation portion 61*f* is formed at the lower portion of the guide rail 61. The pulley installation portion 61*f* extends laterally at a side opposed to the driving portion 53, from the main body portion 61*a*.

In the pulley installation portion 61*g*, an inclination restraining pulley 91, which is a component of the inclination restraining mechanism described later, is rotatably installed at a pin 93 which is to be disposed at a hole 61*i* formed at the pulley installation portion 61*g*.

As illustrated in FIG. 1, the driving portion 53 installed at the inner panel is disposed at one side of the guide rail 61. This driving portion 53 includes a drum 101 around which a wire 111, and a wire 113 are wound and a motor 103 that rotatably drives the drum 101 in normal and reverse directions.

As illustrated in FIGS. 1 and 4, the wire 113 wound around the drum 101 is wound on the upper groove 83*a* of the lower pulley 83 to be installed from below at a second wire installation portion 63*g* formed at the slider 63.

A first wire installation portion 63*f* and the second wire installation portion 63*g* are offset in the vertical direction, viewing from the thickness direction of the glass 51. Therefore, the wire 111 that heads for the slider 63 from the upper pulley 73 and the wire 113 that heads for the slider 63 from the lower pulley 83 are positioned on approximately an identical straight line.

Accordingly, when the motor 103 of the driving portion 53 normally rotates, the wire 111 is drawn (paid out) from the drum 101, and then, the wire 113 is pulled (rolled up). The glass 51 secured to the slider 63 is pulled by the wire 113 to lower along the guide 61.

Conversely, when the motor 103 of the driving portion 53 reversely rotates, the wire 111 is pulled (rolled up) from the drum 101, and then, the wire 113 is drawn (paid out). The glass 51 secured to the slider 63 is pulled by the wire 111 to rise along the guide 61.

(Inclination Restraining Mechanism 57)

Next, the inclination restraining mechanism 57 will be described.

A third wire installation portion 63*h* is formed at a position opposed to the upper pulley 73, of the slider 63 as a member secured to the glass 51. One end portion of a traction wire 121 as a traction member is installed at the third wire installation portion 63*h*. This traction wire 121 extends above from the third wire installation portion 63*h* of the slider 63. Then, the traction wire 121 is wound across the lower groove 73*b* of the upper pulley 73, the lower groove 83*b* of the lower pulley 83, and the inclination restraining pulley 91, in this order. Then, another end portion of the traction wire 121 is installed from below at a fourth wire installation portion 63*i* formed at a position opposed to the inclination restraining pulley 91.

Here, the third wire installation portion 63*h* is a position where the one end portion of the traction wire 121, which is the traction member, is installed at the slider 63, which is the member secured to the glass 51. The fourth wire installation portion 63*i* is a position where the other end portion of the traction wire 121, which is the traction member, is installed at the slider 63, which is the member secured to the glass 51. The third wire installation portion 63*h* and the fourth wire installation portion 63*i* are offset in the horizontal direction, viewing from the thickness direction of the glass 51.

Further, so as to be across the first wire installation portion 63*f*, which is the installation position of the wire 111, and the second wire installation portion 63*g*, which is the installation position of the wire 113, of the slider 63 of the raising/lowering mechanism 55, the third wire installation portion 63*h* at which the one end portion of the traction wire 121, which is the traction member, is installed is positioned at its one side, and the fourth wire installation portion 63*i* at which the other end portion of the traction wire 121, which is the traction member, is installed is positioned at its another side.

Then, a configuration of the inclination restraining mechanism 57 includes the slider 63 as the member secured to the glass 51, the upper pulley 73 having the lower groove 73*b* as a traction member guide, and the lower pulley 83 having the lower groove 83*b* as the traction member guide. Here, the upper pulley 73 and the lower pulley 83 are disposed at the guide rail 61, which is the door panel or a member disposed at the door panel. Then, such that the upper pulley 73 and the lower pulley 83 are across the slider 63, which is the member secured to the glass 51, the upper pulley 73 is disposed above the slider 63, and the lower pulley 83 is disposed below the slider 63.

Furthermore, the configuration of the inclination restraining mechanism 57 includes the inclination restraining pulley 91 and the traction wire 121 as the traction member. The traction wire 121 is wound across the respective traction member guides (the upper pulley 73, the lower pulley 83, and the inclination restraining pulley 91). Then, the one end portion of the traction wire 121 is installed at the slider 63, which is the member secured to the glass 51, from above. Then, the other end portion of the traction wire 121 is installed at the slider 63, which is the member secured to the glass 51, from below.

In this embodiment, in the traction wire 121 as the traction member of the inclination restraining mechanism 57, a part installed at the slider 63 as the member secured to the glass 51 from the upper pulley 73 as the traction member guide disposed at the upper side of the guide rail 61 as the door panel or the member disposed at the door panel, and a part installed at the slider 63, which is the member secured to the glass 51 from the lower pulley 83 as the traction member guide disposed at the lower side of the guide rail 61, which is the door panel or the member disposed at the door panel, are parallel routed, viewing from the thickness direction of the glass 51.

According to the inclination restraining mechanism 57 with the above-described configuration, the following advantageous effects are obtained. (1) In the horizontal direction, viewing from the thickness direction of the glass, the slider 63 secured to the glass 51 are supported at points at three positions: the first wire installation portion 63*f* and the second wire installation portion 63*g*, the third wire installation portion 63*h*, and the 44th wire installation portion 63*i*.

Further, the one end portion of a traction wire 112 is installed from above at the slider 63, which is the member secured to the glass 51. Then, its other end portion is installed from below at the slider 63, which is the member secured to the glass 51.

Accordingly, centering on the thickness direction of the glass 51, when the glass 51 attempts to incline in an arrow I direction in FIG. 1, tension applied to the traction wire 112 installed at the third wire installation portion 63*h* and the traction wire 112 installed at the fourth wire installation portion 63*i* restrains an inclination of the glass 51.

(2) In the traction wire 121 (the traction member of the inclination restraining mechanism 57), the part installed at the slider 63 (the member secured to the glass 51) from the upper pulley 73 (the traction member guide) disposed at the upper side of the guide rail 61 (the door panel or the member disposed at the door panel, and the part installed at the slider 63 (the member secured to the glass 51) from the lower pulley 83 (the traction member guide) disposed at the lower side of the guide rail 61 (the door panel or the member disposed at the door panel) are parallel routed, viewing from the thickness direction of the glass 51. This can more effectively restrain the inclination of the glass 51, regardless of raising/lowering positions of the glass 51.

(3) So as to be across the first wire installation portion 63*f*, which is the installation position of the wire 111, and the second wire installation portion 63*g*, which is the installation position of the wire 113, of the slider 63 of the raising/lowering mechanism 55, the third wire installation portion 63*h* at which the one end portion of the traction wire 121, which is the traction member, is installed is positioned at its one side, and the fourth wire installation portion 63*i* at which the other end portion of the traction wire 121, which is the traction member, is installed is positioned at its another side. This can restrain the inclination of the glass 51 across a rotational center of the slider 63. Therefore, this can more effectively restrain the inclination of the glass 51.

Figure 7:
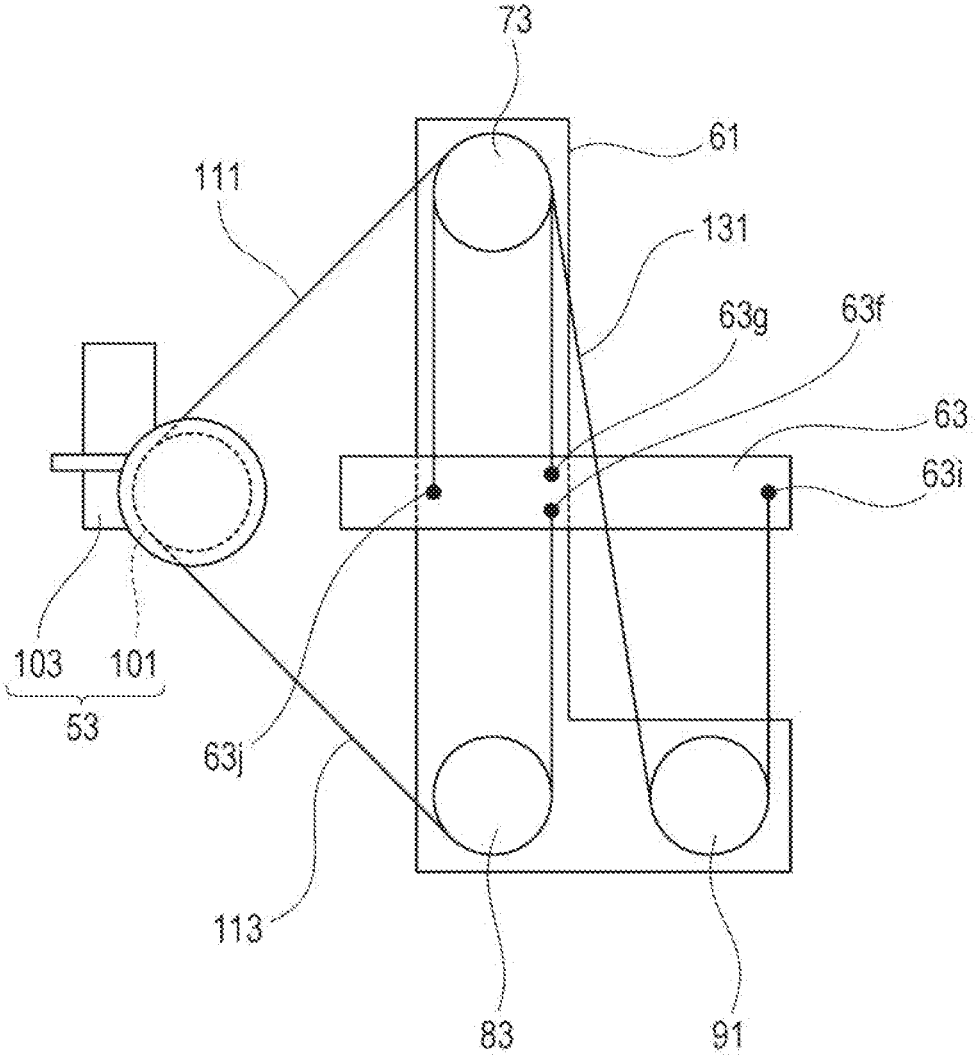
FIG. 7 is a drawing that illustrates a modification of a first embodiment.

The present invention is not limited to the above-described embodiment. For example, this embodiment may have a configuration as illustrated in FIG. 7. Difference between the configuration illustrated in FIG. 7 and the configuration illustrated in FIGS. 1 to 6 is a position of a wire installation portion to a slider and a way of winding of a traction wire. Other parts are identical. Accordingly, the same reference numerals are given to identical parts, and the repeated description will be omitted.

In the drawing, one end portion of a traction wire 131 as the traction member is installed at a third wire installation portion 63*j* of the slider 63. This traction wire 131 extends above from the third wire installation portion 63*j* of the slider 63. Then, the traction wire 131 is wound across the lower groove 73*b* of the upper pulley 73, and the inclination restraining pulley 91, in this order. Furthermore, the traction wire 131 is installed from below at the fourth wire installation portion 63*i* formed at the position opposed to the inclination restraining pulley 91.

The inclination restraining mechanism with such configuration also can obtain advantageous effects similar to that of the configuration illustrated in FIGS. 1 to 6.

Second Embodiment

The description will be given using FIG. 8. Difference between this embodiment and the first embodiment is an inclination restraining mechanism. One pulley is used for only the inclination restraining mechanism of the first embodiment. However, two pulleys are used in the second embodiment. Then, the raising/lowering mechanism is identical. Accordingly, the same reference numerals are given to parts identical to that in FIGS. 1 to 7 that illustrate the first embodiment, and the repeated description will be omitted.

An upper inclination restraining pulley 193 and the upper pulley 73 are disposed at an upper portion of a guide rail 161, from a driving portion 53 side.

A lower inclination restraining pulley 191 and the lower pulley 783 are disposed at a lower portion of the guide rail 161, from the driving portion 3 side.

The wire 111 of the raising/lowering mechanism 55 is wound on the upper pulley 73. Then, the wire 111 is installed at a second wire installation portion 163*g* of a slider 163 movably engaged with the guide rail 163, from above. The wire 113 is wound on the lower pulley 183. Then, the wire 113 is installed at a first wire installation portion 163*f* of the slider 163, from below.

One end portion of a traction wire 221 of an inclination restraining mechanism 155 is installed at a third wire installation portion 163*h* of the slider 163. This traction wire 221 extends above from the third wire installation portion 163*h* of the slider 163. Furthermore, the traction wire 221 is wound across the upper inclination restraining pulley 193, the lower inclination restraining pulley 191, and the lower pulley 83, in this order. Then, the traction wire 221 is installed at a fourth wire installation portion 163*i* of the slider 163, from below.

The inclination restraining mechanism with such configuration also can obtain advantageous effects similar to that of the configuration illustrated in FIGS. 1 to 6.

The present invention is not limited to the above-described embodiment. For example, this embodiment may have a configuration as illustrated in FIG. 9. Difference between the configuration illustrated in FIG. 9 and the configuration illustrated in FIG. 8 is an installation position of a pulley of an inclination restraining mechanism, a position of a traction wire installation portion of a slider, and a way of winding of a traction wire. Other parts are identical. Accordingly, the same reference numerals are given to identical parts, and the repeated description will be omitted.

In the drawing, one end portion of a traction wire 223 as the traction member is installed at a third wire installation portion 163*j* of the slider 163. This traction wire 223 extends above from the third wire installation portion 163*j* of the slider 163. Furthermore, the traction wire 223 is wound across an upper inclination restraining pulley 293 and a lower inclination restraining pulley 291, in this order. Then, the traction wire 223 is installed at a fourth wire installation portion 613*k* of the slider 163, from below.

Figure 8:
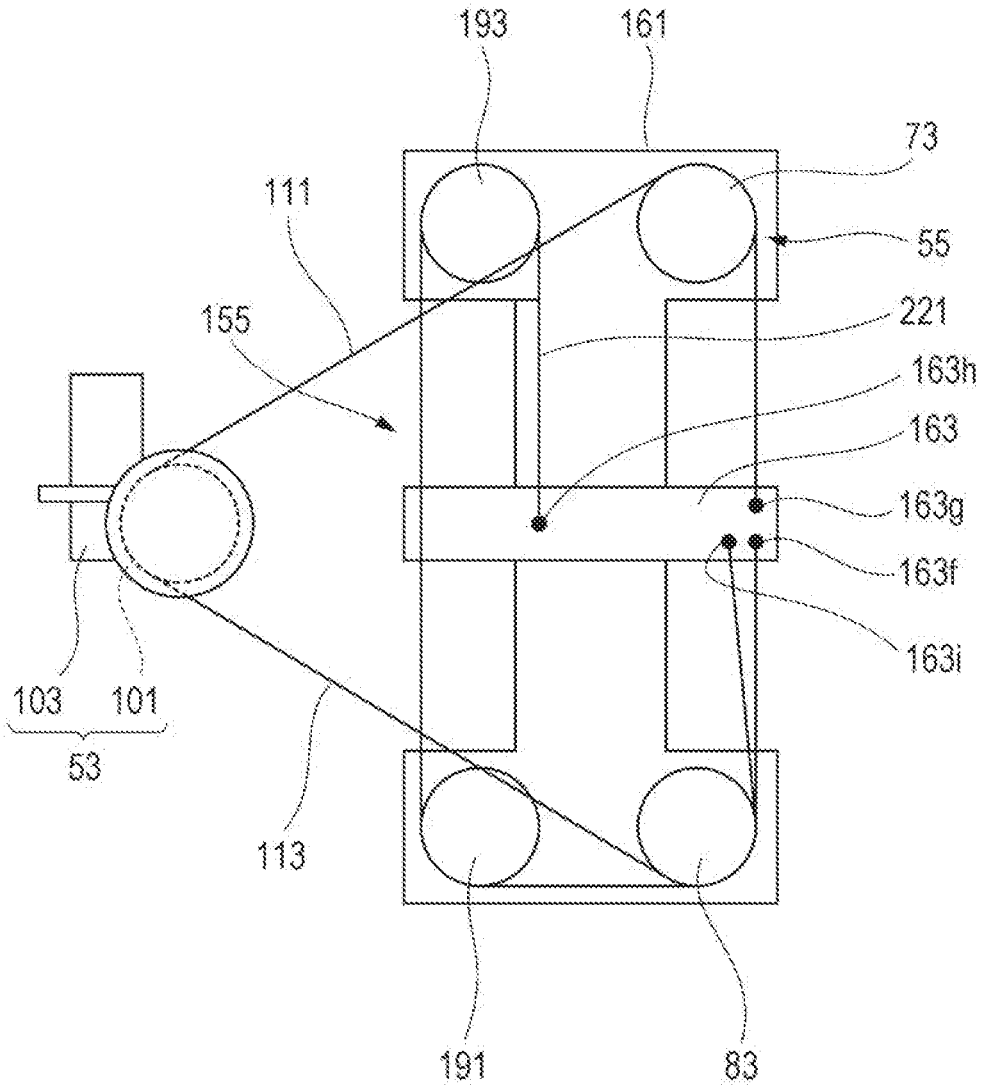
FIG. 8 is a block diagram viewed from front, of a vehicular window regulator of a second embodiment.
Figure 9:
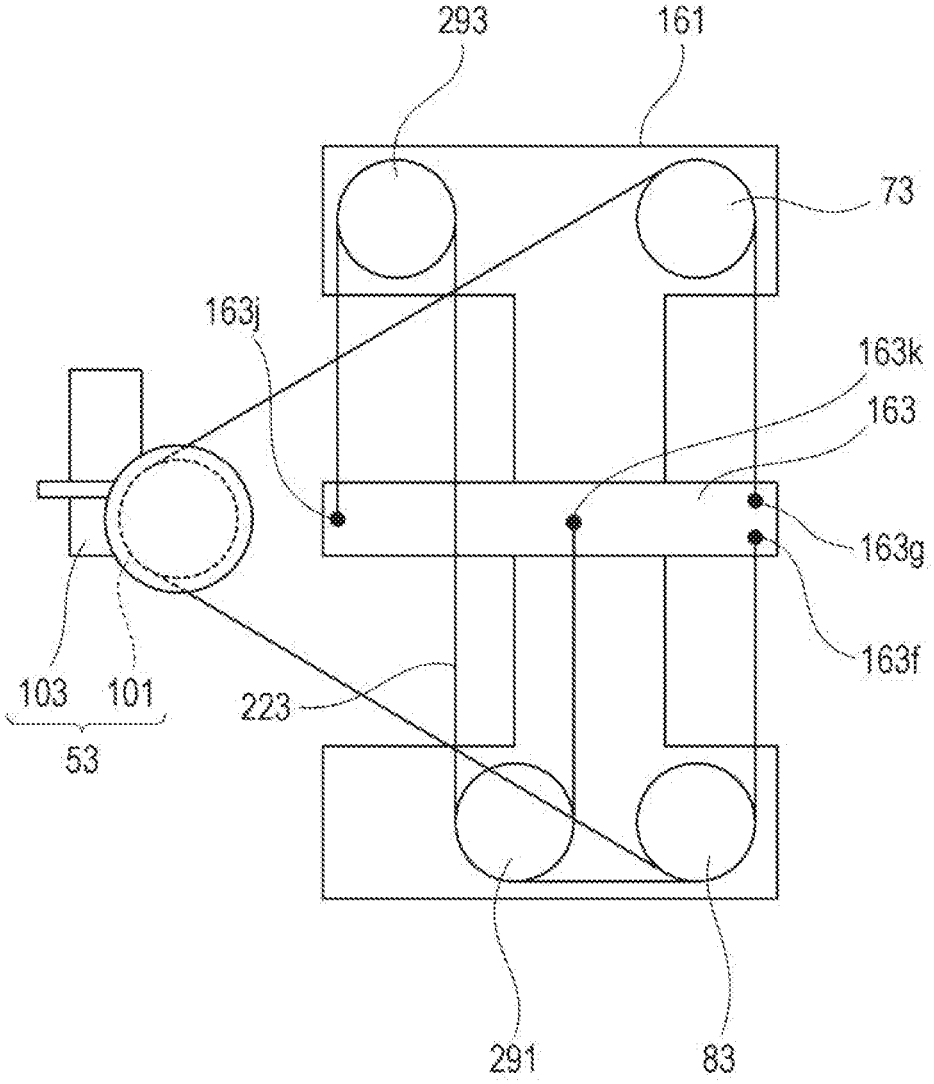
FIG. 9 is a drawing that illustrates a modification of a second embodiment.

The inclination restraining mechanism with such configuration also can obtain the advantageous effects similar to that of the configuration illustrated in FIG. 8.

Third Embodiment

Figure 10:
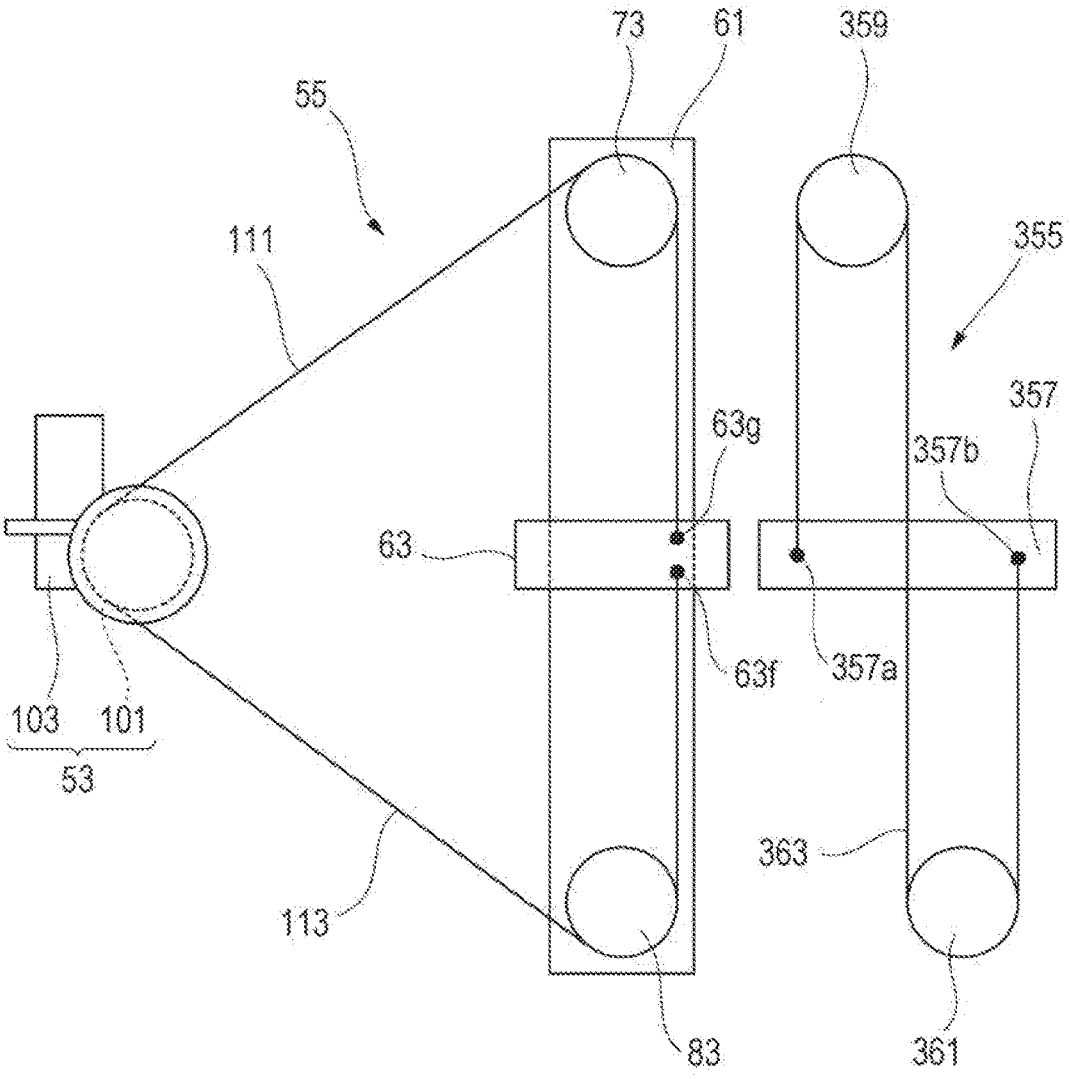
FIG. 10 is a block diagram viewed from front, of a vehicular window regulator of a third embodiment.

The description will be given using FIG. 10. Difference between this embodiment, and the first embodiment and the second embodiment is a point that a mechanism and an inclination restraining mechanism are mutually independent. Then, the raising/lowering mechanism of this embodiment and the raising/lowering mechanism of the first embodiment and the second embodiment are identical. Therefore, the same reference numerals are given to parts identical to that of the raising/lowering mechanism of the first embodiment and the second embodiment, and the repeated description will be omitted.

An inclination restraining mechanism 355 of this embodiment is disposed independently of the raising/lowering mechanism 55. The inclination restraining mechanism 355 includes a base member 357 secured to a window glass, an upper inclination restraining pulley 359 disposed at an upper portion of the inner panel, a lower inclination restraining pulley 361 disposed at a lower portion of the inner panel, and a traction wire 363.

Then, one end portion of the traction wire 363 as the traction member is installed at a third wire installation portion 357*a* of the base member 357. This traction wire 363 extends above from the third wire installation portion 357*a* of the base member 357. Furthermore, the traction wire 363 is wound across the upper inclination restraining pulley 359 and the lower inclination restraining pulley 361, in this order. Then, the traction wire 363 is installed at a fourth wire installation portion 357*b* of the base member 357, from below.

According to such inclination restraining mechanism 355, advantageous effects similar to that of the first embodiment can be obtained.

Further, the raising/lowering mechanism 55 and the inclination restraining mechanism 355 may be independent.

Fourth Embodiment

The description will be given using FIG. 11. Difference between this embodiment and the third embodiment is a point that a pulley used for only an inclination restraining mechanism 455 does not exist. Then, a raising/lowering mechanism of this embodiment and the raising/lowering mechanism of the third embodiment are identical. Therefore, the same reference numerals are given to parts identical to that of the raising/lowering mechanism of the third embodiment, and the repeated description will be omitted.

One end portion of a traction wire 401 as the traction member is installed at a third wire installation portion 63*l* of the slider 63. This traction wire 401 extends above from the third wire installation portion 63*l* of the slider 63. Furthermore, the traction wire 401 is wound across the lower groove 73*b* of the upper pulley 73 and the lower groove 83*b* of the lower pulley 83, in this order. Then, the traction wire 401 is installed at a fourth wire installation portion 63*m* of the slider 63, from below.

According to such inclination restraining mechanism 455, advantageous effects similar to that of the first embodiment can be obtained.

Further, the pulley of the raising/lowering mechanism 55 doubles as the pulley of the inclination restraining mechanism 455 to achieve space saving.

The present invention is not limited to the above-described embodiment. For example, this embodiment may have a configuration as illustrated in FIG. 12. Difference between the configuration illustrated in FIG. 11 and the configuration illustrated in FIG. 12 is an installation position of a wire of a raisin lowering mechanism. Other parts are identical. Accordingly, the same reference numerals are given to identical parts, and the repeated description will be omitted.

In the drawing, the wire 113 of the raising/lowering mechanism 55 is wound on the lower pulley 83. Then, the wire 113 is installed at a first wire installation portion 63*n* formed at a proximity of the third wire installation portion 63*l* of the slider 63.

The inclination restraining mechanism with such configuration also can obtain advantageous effects similar to that of the configuration illustrated in FIG. 12.

Fifth Embodiment

Figure 13:
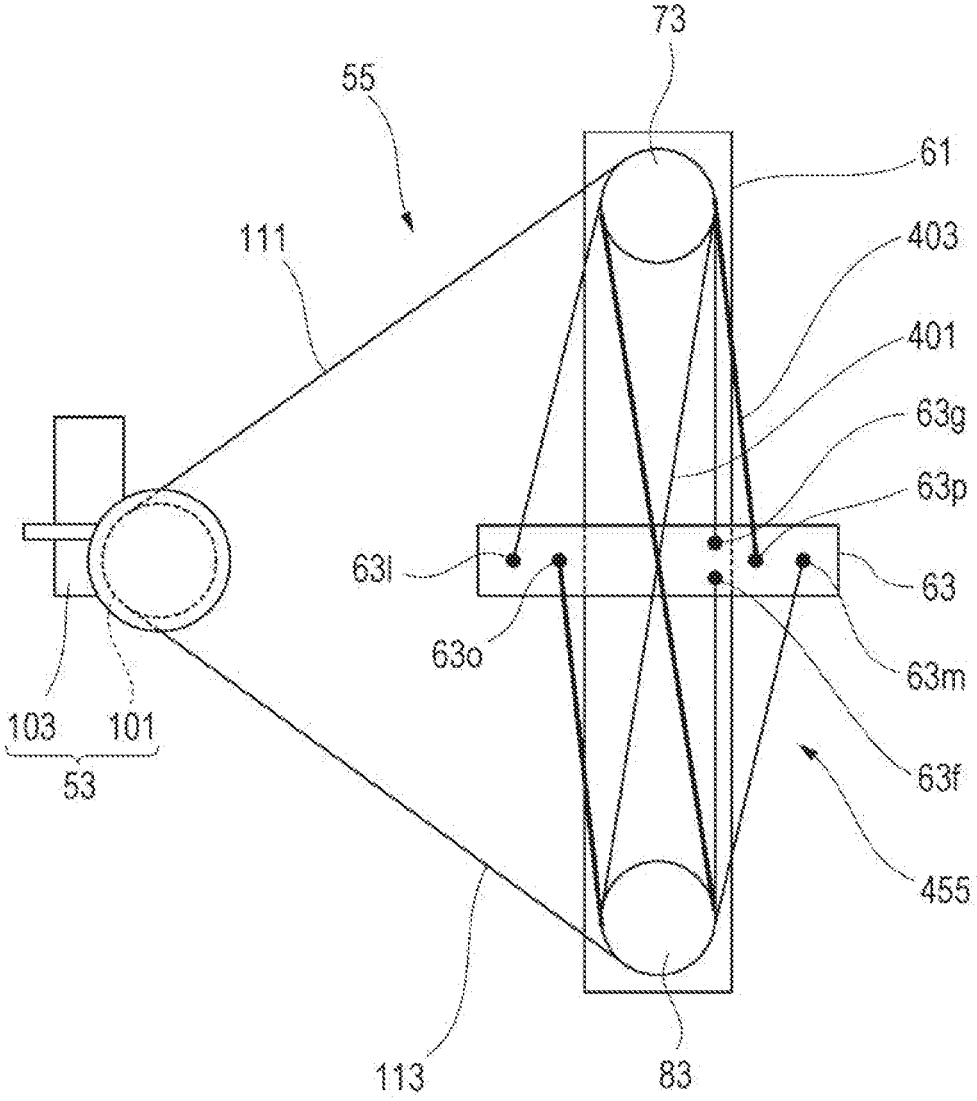
FIG. 13 is a block diagram viewed from front, of a vehicular window regulator of a fifth embodiment.
Figure 14:
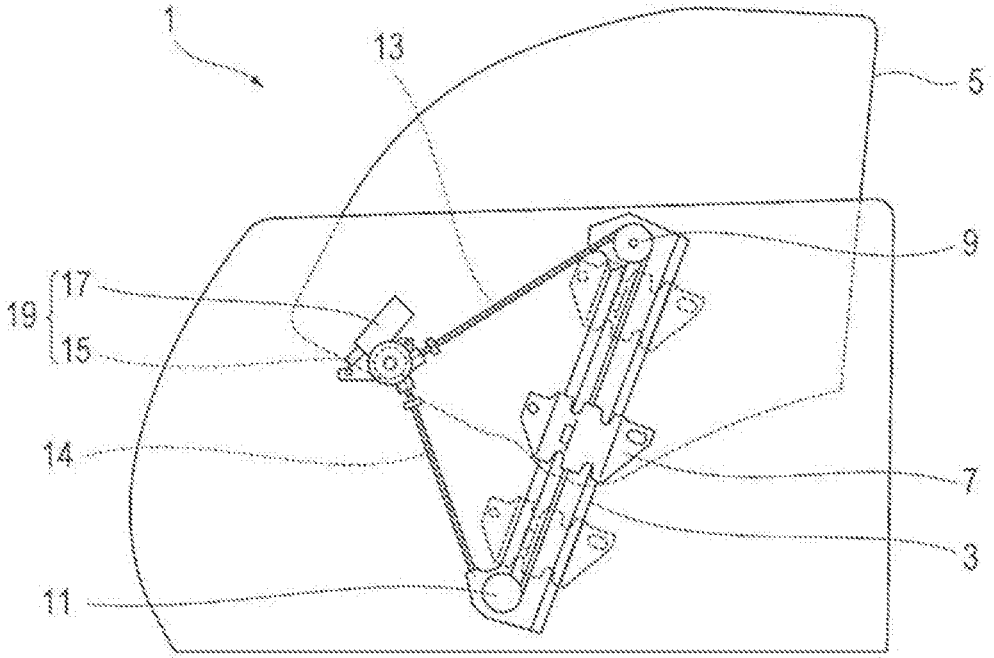
FIG. 14 PRIOR ART
FIG. 14 is a drawing that illustrates a typical vehicular window regulator.

The description will be given using FIG. 13. Difference between this embodiment and FIG. 11 of the fourth embodiment is a point that two traction wires of an inclination restraining mechanism exist. Then, other points are identical. Therefore, the same reference numerals are given to identical parts, and the repeated description will be omitted.

In this embodiment, the inclination restraining mechanism 455 includes two wires: the traction wire 401 and a traction wire 403.

One end portion of the traction wire 403 as the traction member is installed at a fifth wire installation portion 63*o* of the slider 63. This traction wire 403 extends below from the fifth wire installation portion 63*o* of the slider 63. Furthermore, the traction wire 403 is wound across the lower groove 83*b* of the lower pulley 83 and the lower groove 73*b* of the upper pulley 73, in this order. Then, the traction wire 403 is installed at a sixth wire installation portion 63*p* of the slider 63, from above.

Away of winding across the pulleys of the traction wire 401 and a way of winding across the pulleys of the traction wire 403 are mutually inverse.

Figure 11:
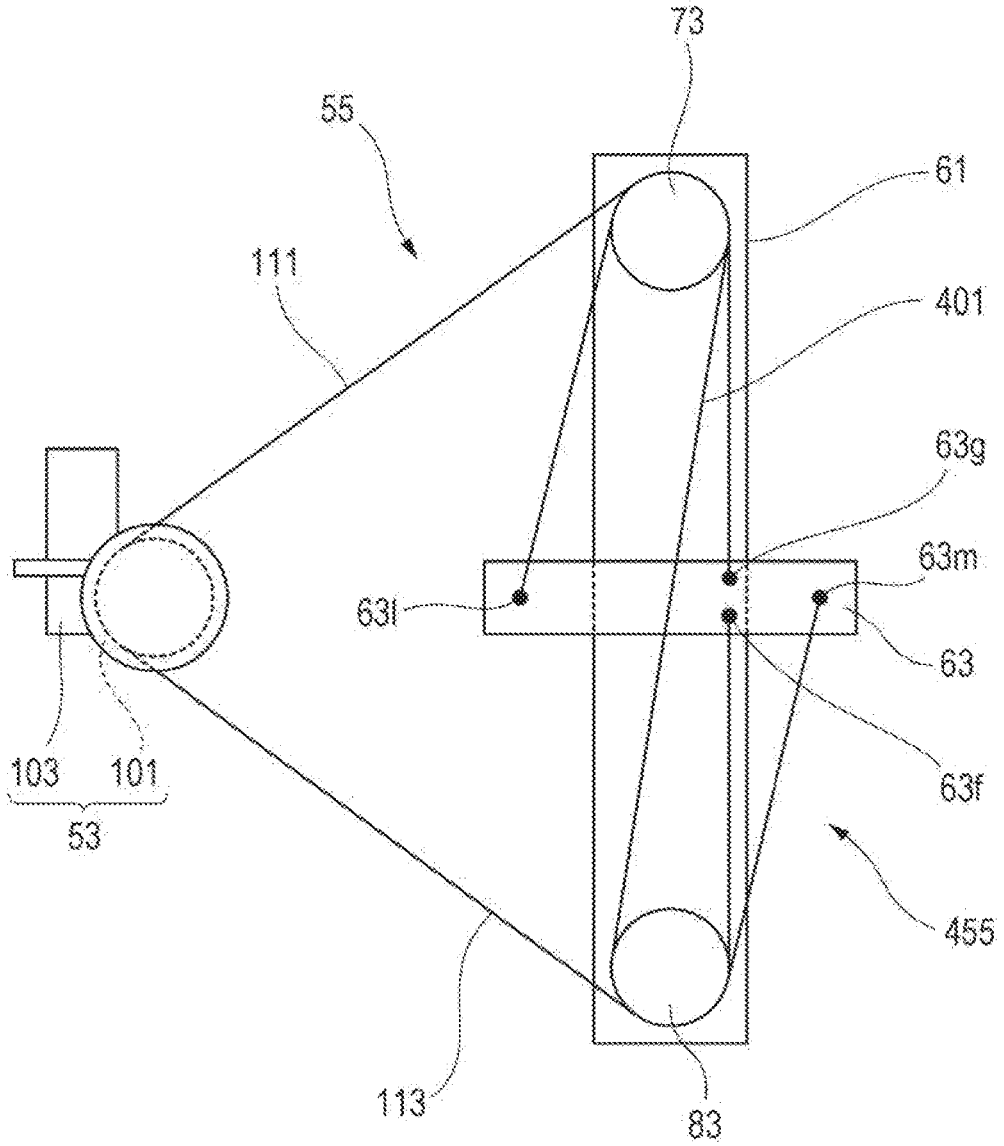
FIG. 11 is a block diagram viewed from front, of a vehicular window regulator of a fourth embodiment.
Figure 12:
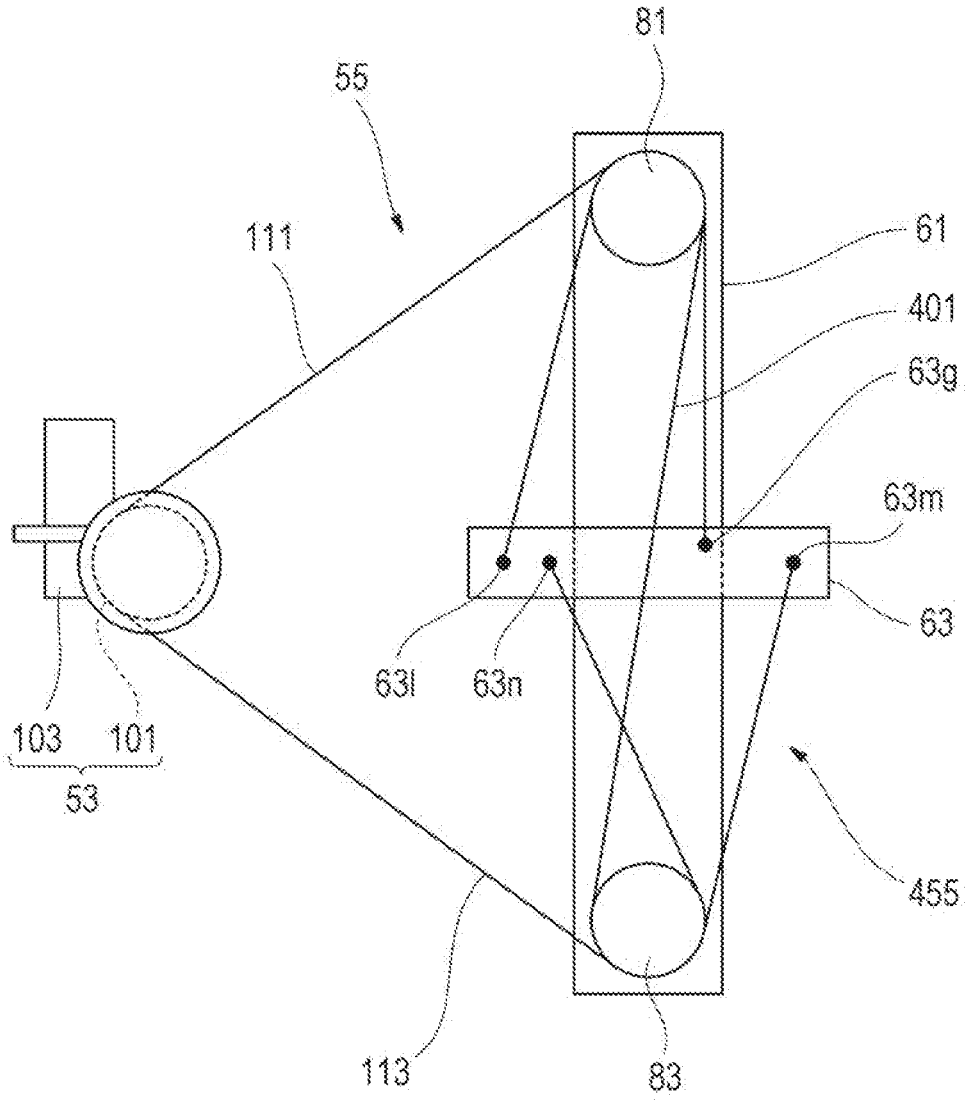
FIG. 12 is a drawing that illustrates a modification of a fourth embodiment.

According to the inclination restraining mechanism with such configuration, in addition to the advantageous effects of the inclination restraining mechanism with the configuration illustrated in FIG. 11, disposing the traction wire 401 and the traction wire 403 having different ways of winding across the pulleys can restrain inclination in a normal rotation direction and a reverse rotation direction, centering the thickness direction of the glass.

Further, the present invention is not limited to the above-described first to fifth embodiments. The traction member of the inclination restraining mechanism is not limited to the wire. Other than the wire, for example, a belt or a chain may be the traction member.

The member on which the wire is wound is not limited to the pulley. The member on which the wire is wound may be a fixed guide.

This application claims priority from Japanese Patent Application No. 2014-196853 filed on Sep. 26, 2014, the entire contents of which are hereby incorporated by reference.

The above description of specific embodiments of the present invention is disclosed as illustrative. This does not intend to be exhaustive or limit the present invention to the described embodiments as they are. Many modifications and variations will be apparent to one of ordinary skill in the art in light of the above teachings.

LIST OF REFERENCE NUMERALS

51: Glass
63: Slider
73: Upper pulley
83: Lower pulley
91: Inclination restraining pulley
121: Traction wire

The invention claimed is:

1. A vehicular window regulator comprising:

a raising/lowering mechanism that includes a driving portion that generates driving force that lowers and raises a glass, and lowers and raises the glass in a vertical direction; and an inclination restraining mechanism that is driven by raising/lowering operation of the raising/lowering mechanism, and restrains rotation of the glass centering on a thickness direction of the glass, wherein the raising/lowering mechanism includes:

one guide rail disposed along the vertical direction;

a slider movably engaged with the guide rail, and to which the glass is secured;

a wire guide disposed at at least one of an upper portion of the guide rail and a lower portion of the guide rail;

a wire that includes a part wound on the wire guide to be installed at the slider, and further pulls the slider along the guide rail; and the driving portion that includes a drum on which the wire is wound to rotate the drum to pull out and draw in the wire, the inclination restraining mechanism includes:

a first member that is secured to the glass;

traction member guides disposed at a door panel or a door panel member that is disposed at the door panel, and at least one of the traction member guides each being disposed above and below the first member, across the first member; and a traction member that is wound across the traction member guides, has one end portion installed from above at the first member, and further has another end portion installed from below at the first member, and an installation position to the first member at the one end portion of the traction member and an installation position to the first member at the other end portion of the traction member are offset in a horizontal direction, viewing from the thickness direction of the glass.

2. The vehicular window regulator according to claim 1, wherein in the traction member of the inclination restraining mechanism, a part installed at the first member from the traction member guide disposed at an upper side of the door panel or the door panel member, and a part installed at the first member from the traction member guide disposed at a lower side of the door panel or the door panel member are parallel routed, viewing from the thickness direction of the glass.

3. The vehicular window regulator according to claim 1, wherein across the installation position of the wire to the slider of the raising/lowering mechanism, the one end portion of the traction member is installed at one side, and the other end portion of the traction member is installed at an other side.

4. A vehicular window regulator comprising:

a raising/lowering mechanism that includes a driving portion that generates driving force that lowers and raises a glass, and lowers and raises the glass in a vertical direction; and an inclination restraining mechanism that is driven by raising/lowering operation of the raising/lowering mechanism, and restrains rotation of the glass centering on a thickness direction of the glass, wherein the inclination restraining mechanism includes:

a first member that is secured to the glass;

traction member guides disposed at a door panel or a door panel member that is disposed at the door panel, and at least one of the traction member guides each being disposed above and below the first member, across the first member; and a traction member that is wound across the traction member guides, has one end portion installed from above via the first member, and further has another end portion installed from below via the first member, and an installation position to the first member at the one end portion of the traction member and an installation position to the first member at the other end portion of the traction member are offset in a horizontal direction, viewing from the thickness direction of the glass.

5. An inclination restraining mechanism that is driven by raising/lowering operation of a raising/lowering mechanism that includes a driving portion that generates driving force that lowers and raises a glass, the raising/lowering mechanism lowering and raising the glass in a vertical direction, the inclination restraining mechanism restraining rotation of the glass centering on a thickness direction of the glass, the inclination restraining mechanism comprising:

a first member that is secured to the glass;

traction member guides disposed at a door panel or a door panel member that is disposed at the door panel, and at least one of the traction member guides each being disposed above and below the first member, across the first member; and a traction member that is wound across the traction member guides, has one end portion installed from above via the first member, and further has another end portion installed from below via the first member, wherein an installation position to the first member at the one end portion of the traction member and an installation position to the first member at the other end portion of the traction member are offset in a horizontal direction, viewing from the thickness direction of the glass.

* * * * *